US006714726B1

(12) United States Patent
Mitani et al.

(10) Patent No.: US 6,714,726 B1
(45) Date of Patent: Mar. 30, 2004

(54) SHOWER WARM WATER CAPACITOR

(76) Inventors: Shigeto Mitani, 14851 Jeffrey Rd., #60, Irvine, CA (US) 92618; Michael Mitani, 14851 Jeffrey Rd., #60, Irvine, CA (US) 92618

( * ) Notice: Subject to any disclaimer, the term of this patent is extended or adjusted under 35 U.S.C. 154(b) by 61 days.

(21) Appl. No.: 10/346,477

(22) Filed: Jan. 17, 2003

(65) Prior Publication Data

(65)

(51) Int. Cl.[7] ..... F24C 13/00
(52) U.S. Cl. ..... 392/467; 4/598
(58) Field of Search ..... 392/465, 466, 392/462, 467, 479; 137/341; 219/200; 4/598

(56) References Cited

U.S. PATENT DOCUMENTS 1,057,760 A * 4/1913 Miles ..... 392/492
1,805,885 A * 5/1931 Rinderspacher et al. .... 392/493
3,557,389 A * 1/1971 Scobey ..... 4/524
4,085,308 A * 4/1978 Youngquist ..... 392/493
D294,288 S * 2/1988 Blanco ..... D23/318

* cited by examiner

*Primary Examiner*—Sang Y. Paik
*Assistant Examiner*—Thor Campbell
(74) *Attorney, Agent, or Firm*—Clement Cheng

(57) ABSTRACT

A shower fixture for installation between a shower nozzle and shower supply pipe comprising: a top lid member comprising an inlet pipe, an outlet pipe, wherein the top lid member is integrally formed; an insulated main tank member for containing water, the insulated main tank member having an opening, wherein the top lid member is shaped to form a watertight seal with the periphery of the opening in the insulated main tank member, wherein the inlet pipe leads to the bottom portion of the main tank member; an electrically heated hot plate cooperating at low voltage, and attached to the insulated main tank member.

11 Claims, 3 Drawing Sheets

SHOWER WARM WATER CAPACITOR

DISCUSSION OF RELATED ART

The present invention relates to a shower heat exchanger.

Shower water is often susceptible to wide fluctuations in water temperature. The largest fluctuation is in the beginning when the shower water from the hot water pipe is cold. Another fluctuation occurs when the shower water from the hot water outlet begins warming up. A variety of solutions have been employed to address the problem of the initial cold water coming out of the hot water pipe, when a person is taking a shower.

Recirculating systems take a portion of the hot water and return it to the water heater. These systems require additional plumbing and can greatly increase the cost of building a bathroom. Other tank based systems are bulky and susceptible to leakage problems due to their size and complexity. Raya in U.S. Pat. No. 5,979,775 shows a large tank system that holds shower water in a large tank and adjusts the water shower temperature to a user defined temperature. When a user takes a shower, the water is used from the tank which becomes a closed system. The water is later replenished for later use.

Rivera U.S. Pat. No. 5,012,536 shows that the water diverter device that sends the initial cold water to storage. This is not preferable because the cold water is wasted, or a user must manually dispose of the cold water. Postmus U.S. Pat. No. 2,828,766 shows a similar device.

DETAILED DESCRIPTION OF THE PREFERRED EMBODIMENT

Figure 1:
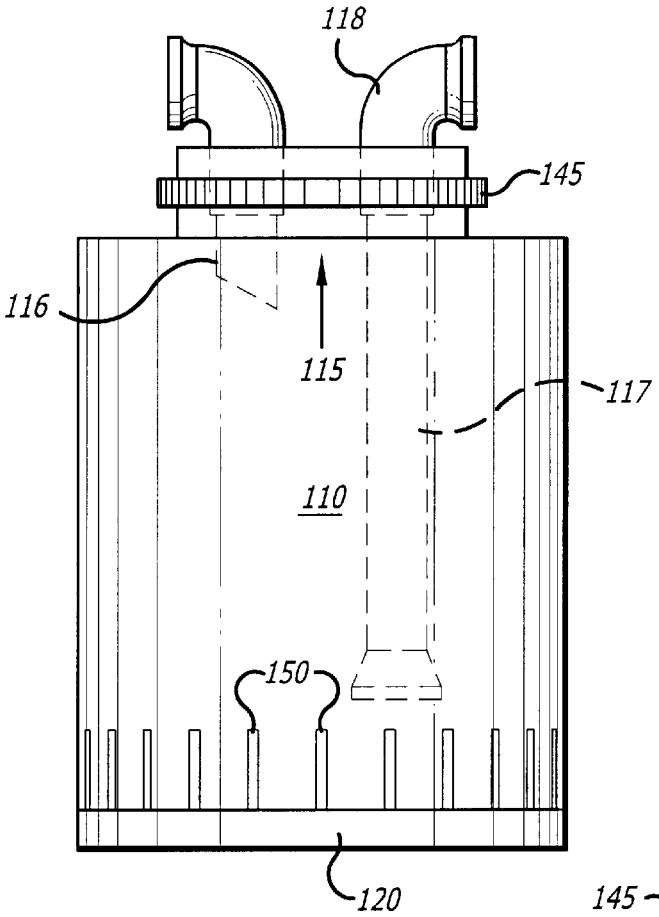
FIG. 1 is a front view of the invention having a type I lid.
Figure 2:
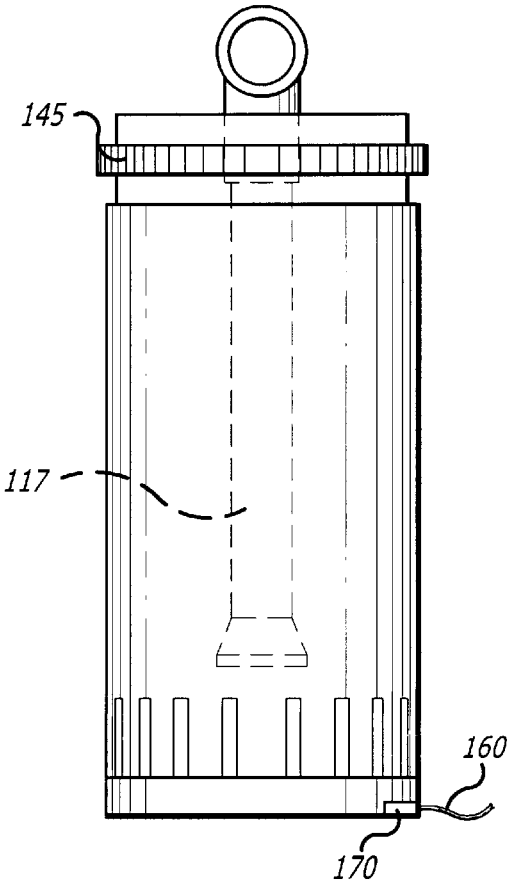
FIG. 2 is a side view of the invention.
Figure 3:
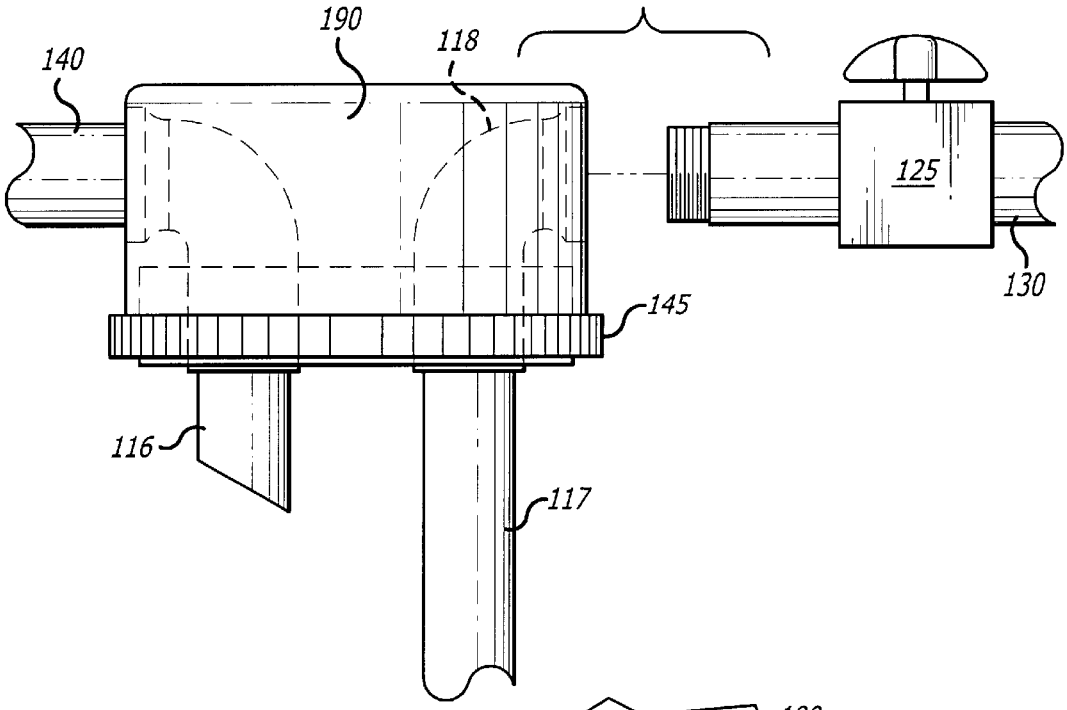
FIG. 3 is a side view of the lid member having a type II lid.
Figure 4:
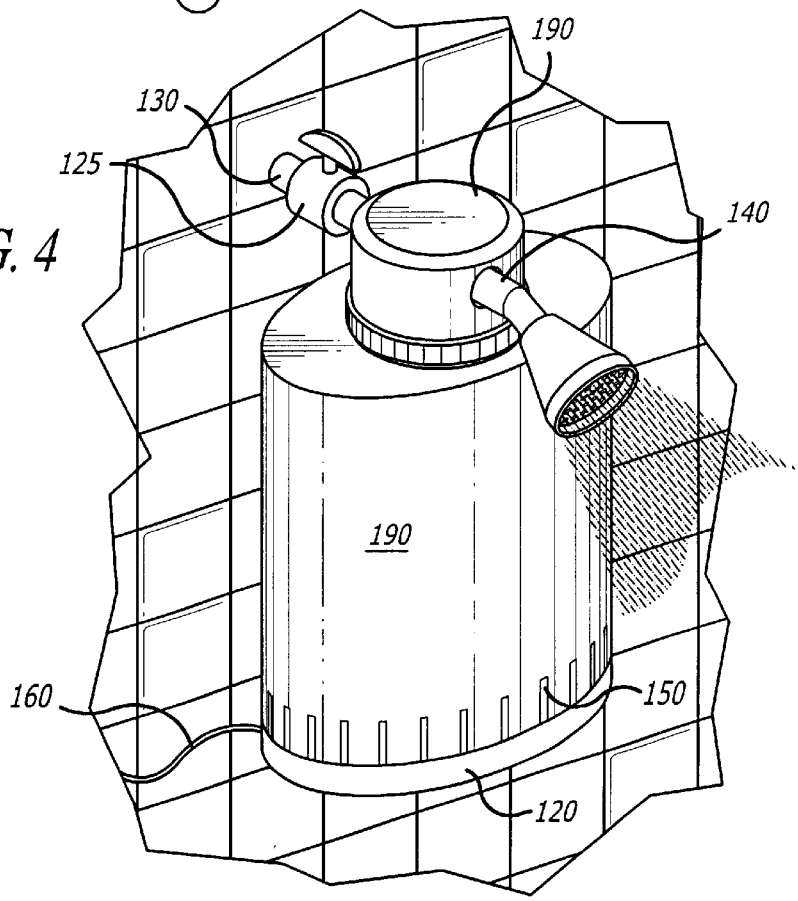
FIG. 4 is a perspective view of the device.
Figure 5A:
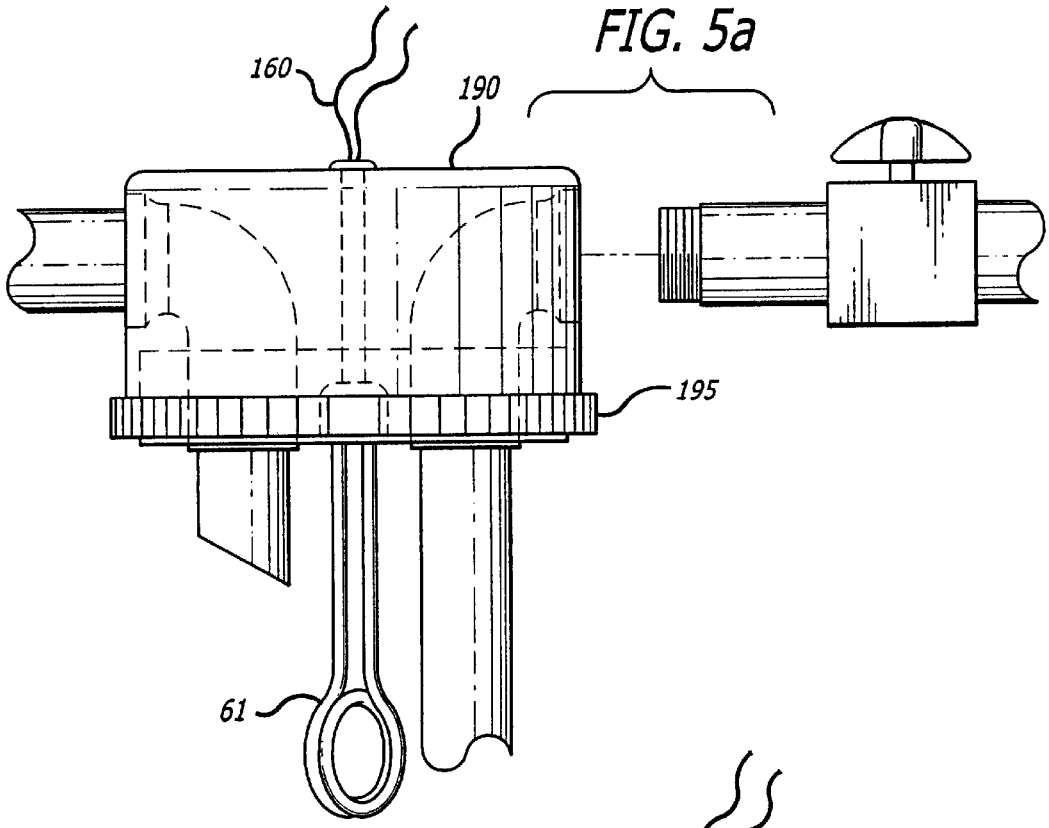
FIG. 5*a* is a side view of the lid having the heating coil configuration.
Figure 5B:
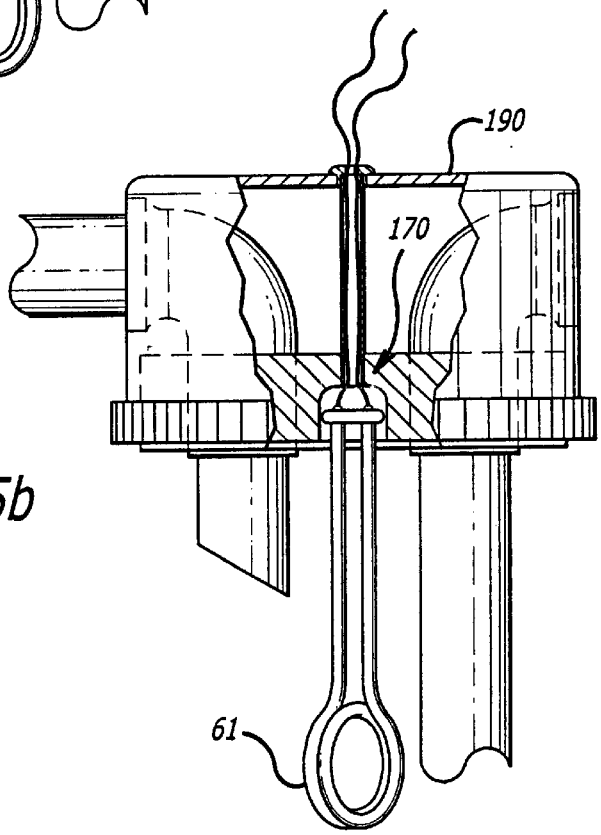
FIG. 5*b* is a side view of the lid having the heating coil configuration.

The present invention stabilizes water flow temperature without using a large tank system or recirculation system.

The present invention comprises a main tank member 110, a lower heating plate element 120, an inlet pipe 130, and an outlet pipe 140. The terminology used here is based on the point of reference of the main tank member 110. Therefore, any water entering the system is denoted as incoming water, and any water exiting the system is called outlet water.

The inlet pipe additionally contains a water flow valve 125 to prevent water from flowing backwards.

A user installs the present invention by removing the showerhead 180 in a shower. The user then connects the inlet pipe to the shower supply pipe. The inlet pipe leads to the main tank member. The user then installs the showerhead on the outlet pipe 140.

There are two kinds of lids, here we will denote them as Type I and Type II. A Type I lid can be made from various individual parts and assembled. A Type I lid additionally features exposed L tube sections. A Type II lid may be injection molded, preferably as one piece of plastic. A Type II lid additionally features a circular top. The Type II lid is preferable for aesthetic purposes.

The inlet and outlet pipe are preferably formed as an integral single piece of plastic also formed with a circular lid having a circular top. This piece is the lid member that comprises the inlet pipe and outlet pipe. This allows the user to install the inlet pipe formed with the lid member to the shower supply pipe. The user then attaches the main tank member to the lid member 190. The user also replaces the showerhead 180 to the outlet pipe 140 of the device.

The insulated main tank member has an opening; the top lid member is shaped to form a watertight seal with the periphery of the opening in the insulated main tank member. The main tank member may be insulated by a single wall construction or a double wall construction. In a double wall construction, the wall may be air evacuated for improved thermal resistance. The interior of the main tank member may also be covered with a silvered, or reflective coating for preventing radiation heat loss.

The top lid section comprises the inlet pipe and the outlet pipe. The inlet pipe may further include a lead pipe supply water member and the outlet pipe may further include a lead pipe feeding water member 116. Thus, the inlet pipe may be defined as two sections: a first section being an L shaped inlet coupling 118 for connection with the shower supply water pipe; and a second section being the lead pipe supply water member 117. Similarly, the outlet pipe may be defined as two sections: the first section being an L shaped outlet coupling 118 where water goes to the shower head, and a second section being the lead pipe feeding water member 116. A lead pipe can be removable for cleaning of the lid and for ease of construction.

A free cap 145 secures the lid member to the main tank member. The free cap 145 rotates freely about threaded helical screw on the lid to close the lid on the main tank member. The free cap 145 is preferably retained on the lid so it is not lost.

The main tank member 110 additionally includes heat transfer fins 150 attached to a heating element preferably a lower heating plate. The heated plate warms the heating fins. The heat fin configuration 150 is preferably a series of planar metal protrusions that protrude from the lower heating plate 120.

Lower voltage is preferable to high-voltage. The lower heating plate 120 may also include a coupling to a cord electrical outlet for plugging into 120V AC household current. Preferably the heating element operates on 12V DC power for safety considerations. Electrical resistance heats the lower heating plate. The heating of a heating plate by an electrical resistance is commonly known.

As an alternative to the electrical heating plate configuration, the invention may heat the water by a resistance heater encapsulated in a heating coil. Use of the resistance-heating coil in the main tank member allows a greater rate of heat transfer from the heating element to water.

Upon first use, the user turns on the hot and/ or cold water. The water enters the inlet pipe and fills the main tank member. The water mixes in the main tank member due to the heat fin configuration. The heat fins, are preferably mounted on the bottom part of the main tank member and extend axially from the periphery of the main tank member. The heat fins additionally transfer heat from the heating element to the inlet water. Water then flows out of the main tank member and exits the outlet pipe to the showerhead.

When the user turns off the water supply the first time, a valve in the inlet pipe 125 prevents back flow of water.

After the first use, the main tank member 110 warms and stores heated water according to the preset thermostat temperature. A thermostat in the heating plate maintains a constant temperature of the main heating plate and the main tank member 110. Subsequent uses mix the stored heated water with the initial inlet water.

Additionally, a silver like coating of the interior of the main tank member may insulate the device, or the interior supply pipes. A variety of material coatings may be used. These materials characterized by visually reflective surfaces are well known in the industry and have relatively low heat emittance. Loss of radiative heat saves electricity.

Thus, initial cold water mixes with stored hot water to allow a user to take a warm water shower. Subsequent lukewarm water mixes with warm water to allow a user to take a warm water shower. The thermal capacity of the tank 110 can be sized to the amount of cold water held in the hot water pipe.

The inlet pipe preferably leads into to the bottom portion of the main tank member for better mixing and convection heat transfer. The main tank member is insulated to prevent heat loss.

The foregoing describes the preferred embodiments of the invention and modifications may be made without departing from the spirit and scope of the invention as set forth in the following claims.

Call Out List of Elements

110 Main Tank Member
115 Main Tank Member Opening
116 Lead Pipe Feeding Water Member
117 Lead Pipe Supply Water Member
118 L Shaped Inlet Coupling
120 Lower Heating Plate Element
125 Water Flow Valve
130 Inlet Pipe
140 Outlet Pipe
145 The Free Cap
150 Heating Fins
160 Cord Electrical
170 Thermostat
180 Showerhead
190 Lid Member

What is claimed is:

1. A shower fixture for installation between a shower nozzle and shower supply pipe comprising:

a top lid member comprising an inlet pipe, an outlet pipe, wherein the top lid member is integrally formed, the outlet pipe connectable to a standard shower head, the inlet pipe connectable to a standard home shower outlet;

an insulated main tank member for containing water, the insulated main tank member having an opening, wherein the top lid member is shaped to form a watertight seal with the periphery of the opening in the insulated main tank member, wherein the inlet pipe leads to the bottom portion of the main tank member, wherein the top lid member can be secured to the main tank member;

an electrical heating element operating at low voltage, and secured to the insulated main tank member, the electrical heating element heating water in the insulated main tank member;

a free cap having a helical screw thread fitted over the top lid member, rotating about the top lid member, capable of securing the top lid member to the insulated main tank member.

2. A shower fixture for installation between a shower nozzle and shower supply pipe comprising:

a top lid member comprising an inlet pipe, an outlet pipe, wherein the top lid member is integrally formed, the outlet pipe connectable to a standard shower head, the inlet pipe connectable to a standard home shower outlet;

an insulated main tank member for containing water, the insulated main tank member having an opening, wherein the top lid member is shaped to form a watertight seal with the periphery of the opening in the insulated main tank member, wherein the inlet pipe leads to the bottom portion of the main tank member, wherein the top lid member can be secured to the main tank member;

an electrical heating element operating at low voltage, and secured to the insulated main tank member, the electrical heating element heating water in the insulated main tank member;

an electrical heating element which is a heating plate attached to the bottom of the main tank.

3. A method for heating shower water comprising the steps of:

a) Removing a shower nozzle from a shower supply pipe;

b) Attaching a top lid member to a shower supply pipe, the top lid member comprising an inlet pipe, an outlet pipe, wherein the top lid member is integrally formed;

c) Attaching an insulated main tank member to the top lid member, the insulated main tank member for containing water, the insulated main tank member having an opening, wherein the top lid member is shaped to form a watertight seal with the periphery of the opening in the insulated main tank member, wherein the inlet pipe leads to the bottom portion of the main tank member;

d) Attaching an electrically heated hot plate cooperating at low voltage, and attached to the insulated main tank member, said electrically heated hot plate warming the main tank member.

4. The method of claim 3, wherein the top lid member further comprises, a free cap having a helical screw thread fitted over the top lid member, rotating about the top lid member, capable of securing the top lid member to the insulated main tank member.

5. The method of claim 3, wherein the top lid member further comprises: A back flow valve connected to the inlet supply water pipe.

6. The method of claim 3, wherein the insulated main tank is cylindrical in shape having a circular top opening, wherein the top lid member is cylindrical in shape capable of fitting over the circular top opening of the insulated main tank and forming a watertight seal.

7. The method of claim 3, wherein the main tank is mounted below the top lid member.

8. The method of claim 3, wherein the main tank is mounted above the top lid member.

9. The method of claim 3, wherein the insulated main tank is insulated by a single wall construction and interior reflective coating.

10. The method of claim 3, wherein the insulated main tank is insulated by a double wall construction and interior reflective coating.

11. The method of claim 3, wherein the main tank is available in different sizes, small, medium and large to allow a user interchangeability to adapt to the water heating needs of a particular shower.

* * * * *